US007129408B2

(12) United States Patent
Uehara

(10) Patent No.: US 7,129,408 B2
(45) Date of Patent: Oct. 31, 2006

(54) SEPARATE-TYPE MUSICAL PERFORMANCE SYSTEM FOR SYNCHRONOUSLY PRODUCING SOUND AND VISUAL IMAGES AND AUDIO-VISUAL STATION INCORPORATED THEREIN

(75) Inventor: Haruki Uehara, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 185 days.

(21) Appl. No.: 10/910,017

(22) Filed: Aug. 2, 2004

(65) Prior Publication Data

US 2005/0056141 A1 Mar. 17, 2005

(30) Foreign Application Priority Data

Sep. 11, 2003 (JP) ..... 2003-319320

(51) Int. Cl.
*G10H 7/00* (2006.01)

(52) U.S. Cl. ..... 84/645; 709/208; 709/231; 709/248; 84/601; 84/609; 84/615; 710/53

(58) Field of Classification Search ..... 709/231, 709/233; 84/645
See application file for complete search history.

(56) References Cited

U.S. PATENT DOCUMENTS 5,737,531 A * 4/1998 Ehley ..... 709/208
5,761,439 A * 6/1998 Kar et al. ..... 709/248
5,864,868 A * 1/1999 Contois ..... 707/104.1
6,121,536 A * 9/2000 Malcolm ..... 84/645
6,143,973 A * 11/2000 Kikuchi ..... 84/645
6,247,072 B1 * 6/2001 Firestone ..... 710/53
6,449,653 B1 * 9/2002 Klemets et al. ..... 709/231
6,480,902 B1 * 11/2002 Yuang et al. ..... 709/248
6,525,253 B1 * 2/2003 Kikuchi et al. ..... 84/601
6,653,545 B1 * 11/2003 Redmann et al. ..... 84/615
6,857,130 B1 * 2/2005 Srikantan et al. ..... 725/93
2002/0004839 A1 * 1/2002 Wine et al. ..... 709/231
2006/0053455 A1 * 3/2006 Mani et al. ..... 725/87

* cited by examiner

*Primary Examiner*—Lincoln Donovan
*Assistant Examiner*—Christina Russell
(74) *Attorney, Agent, or Firm*—Morrison & Foerster LLP

(57) ABSTRACT

A separate-type music performance system has a master audio-visual station and a slave audio-visual station remote from the mater audio-visual station and connected through two communication channel independently of each other; MIDI music data codes and click time data codes are transmitted through one of the communication channels to the slave audio-visual station, and audio-visual data codes and a click signal are transmitted through the other communication channel; when the click signal and click time data code arrive the slave audio-visual station, the clock setter 21*e* sets an internal clock with the click time data code paired with the click signal, and the MIDI music data code are transferred to an automatic player piano in comparison with the time data and the internal clock, whereby the tones are produced synchronously with the visual images.

25 Claims, 7 Drawing Sheets

SEPARATE-TYPE MUSICAL PERFORMANCE SYSTEM FOR SYNCHRONOUSLY PRODUCING SOUND AND VISUAL IMAGES AND AUDIO-VISUAL STATION INCORPORATED THEREIN

FIELD OF THE INVENTION

This invention relates to a remote controlling technology for an audio visual reproducer and, more particularly, to a separate-type musical performance system and an audio-visual station incorporated in the musical performance system.

DESCRIPTION OF THE RELATED ART

In a case where a musician or musicians are to be remote from audience, a separate-type musical performance system is required for the concert. A tutor may give music lessons to students remote from him or her. In this situation, the separate-type musical performance system is also required for the remote lessons. The separate-type musical performance system includes a master audio-visual station and a slave audio-visual station, and the master audiovisual station communicates with the slave audio-visual station through a communication network. While the musicians are performing a piece of music on the master audio-visual station, audio data, which represent the tones produced along the piece of music, are transmitted together with visual data through the communication network to the slave audio-visual station, and the tones are reproduced through the slave audio-visual station together with the visual images on a monitor screen.

FIG. 1 shows an example of the separate-type musical performance system. The separate-type musical performance system is broken down into a master audio-visual station 50*a*, a slave audio-visual station 50*b* and the Internet 10. The master audio-visual station 50*a* is connected through the Internet 10 to the slave audio-visual station 50*b*, and audio data and visual/voice data are transmitted from the master audio-visual station 50*a* to the slave audio-visual station 50*b* for the remote performance.

The master audio-visual station 50*a* includes a controller 51, a videophone 52 and an electronic keyboard 53. The electronic keyboard 53 includes an array of keys, a key switch circuit (not shown) and a data processor (not shown), and the data processor is connected through a MIDI interface to the controller 51. While a musician is fingering a piece of music on the array of keys, the depressed keys and released keys cause the switch circuit to turn on and off, and the data processor monitors the switch circuit so as to produce and supply MIDI (Musical Instrument Digital Interface) music data codes through the MIDI interface to the controller 51. Thus, the electronic keyboard 53 is a source of the MIDI music data codes.

The controller 51 includes an internal clock 51*a*, a packet transmitter module 51*b* and a time stamper 51*c*. The internal clock 51*a* measures a lapse of time, and the time stamper 51*c* checks the internal clock 51*a* to see what time the MIDI music data codes arrive thereat. The packet transmitter module 51*b* produces packets in which the MIDI music data codes and time codes are loaded, and delivers the packets to the Internet 10.

While the musician is performing the piece of music, the MIDI music data codes intermittently arrive at the time stamper 51*c*, and the time stamper 51*c* adds the time data codes representative of the arrival times to the MIDI music data codes. The time stamper 51*c* supplies the MIDI music data codes together with the time data codes to the packet transmitter module 51*b*, and the packet transmitter module 51*b* transmits the packets to the slave audio-visual station 50*b* through the internet 10.

The videophone 52 is independent of the electronic keyboard 53, and produces audio data codes and visual data codes from the scene where the musician or tutor acts. The videophone 52 is connected to the Internet 10, and transmits the audio data codes and visual data codes to the slave audio-visual station 50*b*.

The slave audio-visual station 50*b* includes a controller 61, a videophone 62 and an electronic keyboard 63. The controller 61 receives the MIDI music data codes and time data codes, and the MIDI music data codes are timely supplied from the controller 61 to the electronic keyboard 63 so that the electronic keyboard 63 produces the tones along the music passage.

The videophones 52 and 62 form parts of a video conference system or a streaming system. While the audio data codes and visual data codes are arriving at the videophone 62, the videophone 62 produces the visual images and voice from the audio data codes and visual data codes.

The controller 61 includes an internal clock 61*a*, a packet receiver module 61*b* and a MIDI out buffer 61*c*. The packet receiver module 61*b* unloads the MIDI music data codes and time data codes from the packets, and the MIDI music data codes are temporarily stored in the MIDI out buffer 61*c* together with the associated time data codes. The MIDI out buffer 61*c* periodically checks the internal clock 61*a* to see what MIDI music data codes are to be transferred to the electronic keyboard 63. When the time comes, the MIDI out buffer 61*c* delivers the MIDI music data code or codes to the electronic keyboard 63, and an audio signal is produced through a tone generator (not shown) on the basis of the MIDI music data codes. The audio signal is supplied to a sound system (not shown), and the electronic tones are radiated from a loud speaker system (not shown).

Although the visual images and voice are to be produced synchronously with the electronic tones, the visual data codes and audio data codes are transmitted through the communication channel different from the communication channel assigned to the MIDI music data codes without any automatic synchronization. This is because of the fact that the separate communication channels permit the music producer freely to design the performance. Nevertheless, there is not any guarantee that the audio data codes and visual data codes timely reach the videophone 62.

In order to make the visual images and voice synchronously produced together with the electronic tones, a delay circuit 62*a* is connected to the controller 61 and/or the videophone 62, and a human operator manually synchronizes the visual images and voice with the electronic tones by controlling the delay circuit such as 62*a*. Even though the human operator manually synchronizes the visual images and voice with the electronic tones, the synchronism is liable to be broken due to, for example, the traffic of the communication network or the difference in data processing speed between the packet transmitter module 51*b* and the videophone 52. Moreover, the synchronization is less accurate, because the accuracy is dependent on the sense of sight and sense of hearing. Thus, the problem inherent in the prior art separate-type music performance system is the poor synchronization between the electronic tones and the visual images/voice.

Synchronizing techniques are disclosed in Japanese Patent Application No. 2002-7873 and Japanese Patent Application laid-open No. 2003-208164, the inventions of which were assigned to Yamaha Corporation. However, these synchronizing techniques are applied to a playback system, through which the performance is reproduced on the basis of the data stored in a compact disk or floppy disk. It is difficult to apply the synchronizing techniques to the separate-type musical performance system, because any real time network communication is not taken into account in the synchronizing techniques.

SUMMARY OF THE INVENTION

It is therefore an important object of the present invention to provide a music performance system, which makes tones and visual images well synchronized regardless of the distance between audio-visual stations.

It is also an important object of the present invention, which forms a part of the music performance system.

The present inventor contemplated the problem inherent in the prior art music performance system, and noticed the internal clock 51*a* available for the video/audio data. The videophone read the internal clock 51*a*, and produced time codes representative of the lapse of time. The time codes were modulated to part of the audio signal, and were transmitted to the videophone 62 as the part of the audio signal. The part of the audio signal was demodulated to the time codes, and the time codes were compared with the time data codes added to the MIDI music data codes for good synchronization. However, the part of the audio signal was hardly demodulated to the time codes. The reason why the part of the audio signal had been hardly demodulated to the time codes was that the time data were compressed at a high compression rate for the video conference system.

The present inventor gave up the above-described approach, and sought another. The present inventor noticed that a simple sign could make the internal clocks synchronized with one another.

To accomplish the objects, the present invention proposes to periodically set an internal clock of a slave audio-visual station with another internal clock of a master audio-visual station.

In accordance with one aspect of the present invention, there is provided a music performance system for synchronously producing music sound and visual images comprising plural communication channels independently of one another and selectively assigned pieces of music data representative of music sound, pieces of first timing data representative of respective occurrences of the pieces of the music data, pieces of periodical data each representative of a sign of a time period, pieces of second timing data representative of respective occurrences of the pieces of periodical data and pieces of visual data representative of at least an attribute of visual images for propagating therethrough without any guarantee of a time consumed in the propagation, a first audio-visual station including a music data source outputting the pieces of music data together with the associated pieces of first timing data and the pieces of second timing data to one of the plural communication channels, a visual data source outputting the pieces of visual data and the pieces of periodical data to the aforesaid another of the plural communication channels, a time keeper producing the pieces of periodical data at regular intervals, connected to the music data source and the visual data source and determining a first time at which each of the pieces of music data occurs and a second time at which each of the pieces of periodical data occurs, thereby selectively supplying the pieces of first timing data, the pieces of second timing data and the pieces of periodical data to the music data source and the visual data source, and a second audio-visual station connected to the plural communication channels so as to receive the pieces of music data, the pieces of first timing data, the pieces of periodical data, the pieces of second timing data and the pieces of visual data and including an internal clock measuring a third time asynchronously with the time keeper, a clock setter pairing the pieces of second timing data with the associated pieces of periodical data to see whether or not a time difference between arrivals thereat is ignoreable and setting the internal clock right on the basis of the pieces of second timing data and the time difference if the time difference is not ignoreable, a visual image generator supplied with the pieces of visual data so as to produce the visual images and a music sound generator comparing the pieces of first timing data with the third time so as to produce the music sound synchronously with the visual images.

In accordance with another aspect of the present invention, there is provided an audio-visual station remote from a music sound generator and a visual image generator, and the audio-visual station comprises a music data source outputting pieces of music data representative of music sound together with associated pieces of first timing data representative of respective occurrences of the pieces of music data and pieces of second timing data representative of respective occurrences of pieces of periodical data to a communication channel, a visual data source outputting pieces of visual data representative of at least an attribute of visual images and the pieces of periodical data to another communication channel independently of the communication channel and a time keeper producing the pieces of periodical data at regular intervals and determining a first time at which each of the pieces of music data occurs and a second time at which each of the pieces of periodical data occurs, thereby selectively supplying the pieces of first timing data, the pieces of second timing data and the pieces of periodical data to the music data source and the visual data source.

In accordance with yet another aspect of the present invention, there is provided an audio-visual station remote from a music data source and a visual data source and receiving pieces of music data representative of music sound, pieces of first timing data representative of respective occurrences of the pieces of music data, pieces of periodical data each representative of a sign of a time period, and pieces of second timing data representative of respective occurrences of the pieces of periodical data and pieces of visual data representative of an attribute of visual images for synchronously producing the music sound and the visual images, and the audio-visual station comprises an internal clock measuring a time, a clock setter paring the pieces of second timing data with the pieces of periodical data to see whether or not a time difference between the arrivals thereat is ignoreable and setting the internal clock right on the basis of the pieces of second timing data and the time difference if the time difference is not ignoreable, a visual image generator supplied with the pieces of visual data so as to produce the visual images, and a music sound generator comparing the time with another time expressed by the pieces of second timing data so as to produce the music sound synchronously with the visual images.

BRIEF DESCRIPTION OF THE DRAWINGS

The features and advantages of the music performance system and audiovisual station will be more clearly understood from the following description taken in conjunction with the accompanying drawings, in which.

DESCRIPTION OF THE PREFERRED EMBODIMENTS

In the following description, term "MIDI music data" means messages defined in the MIDI protocols, and term "MIDI music data codes" is representative of the MIDI music data, which are coded in the formats defined in the MIDI protocols. Term "audio-visual data" is representative of visual images and/or voice. Term "analog audio-visual signal" is representative of an analog signal, which carries the audio-visual data, and term "audio-visual signal data codes" is representative of a digital signal, which carries the audiovisual data.

Term "click data" is information that a click occurs, and term "click time" is indicative of a time when a click occurs. Term "click time data" is information indicative of the click time. Term "click time data code" is a binary code representative of the clock time data. Term "click signal" is a predetermined pulse train representative of each click.

Term "stamp time" is indicative of a time when a MIDI music data code or codes are stamped, and term "time stamp data" is representative of the stamp time. Term "time stamp data code" is a binary code representative of the time stamp data.

System Configuration

Figure 1:
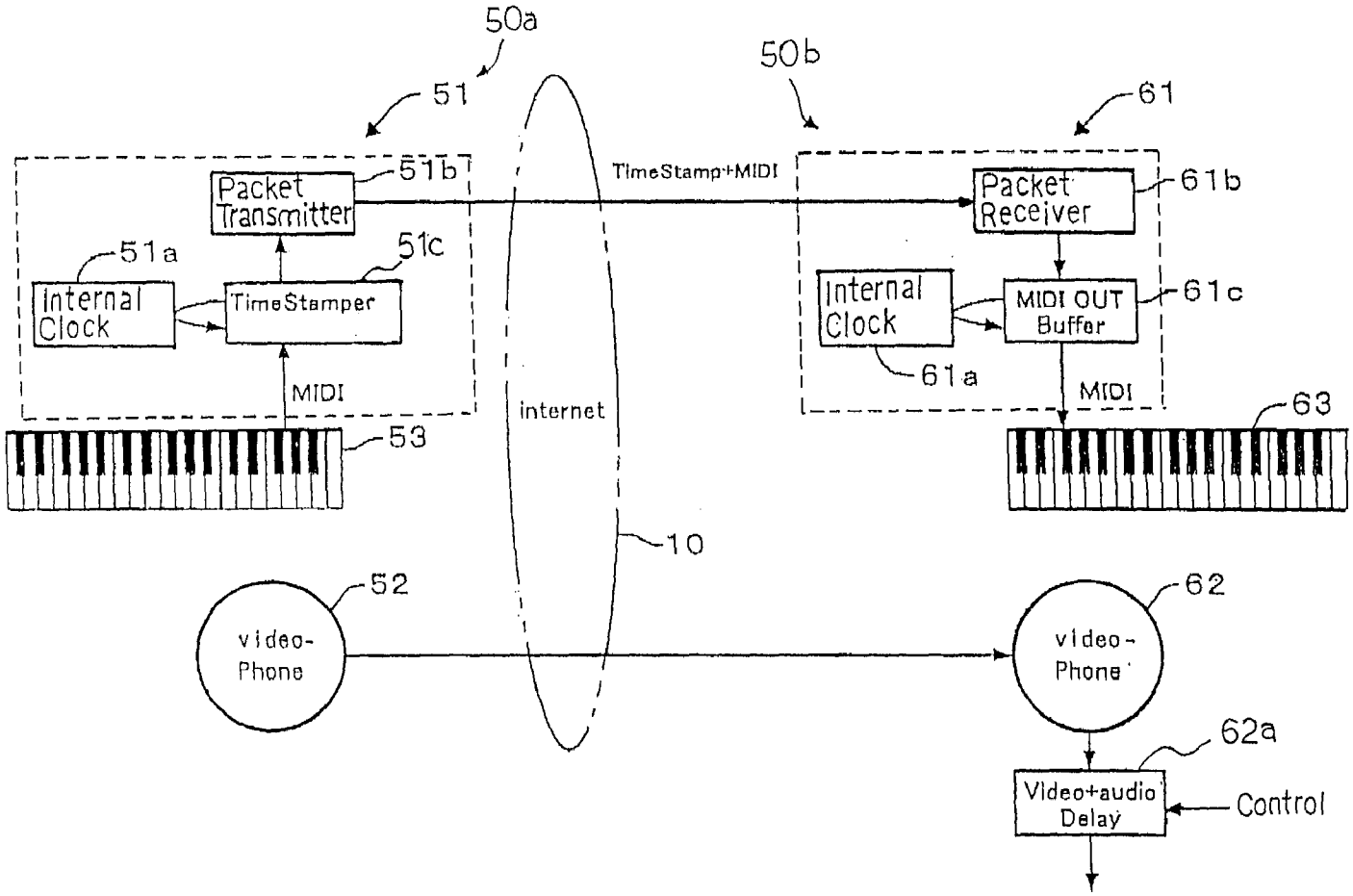
Fig. 1 PRIOR ART
FIG. 1 is a block diagram showing the system configuration of the prior art music performance system.
Figure 2:
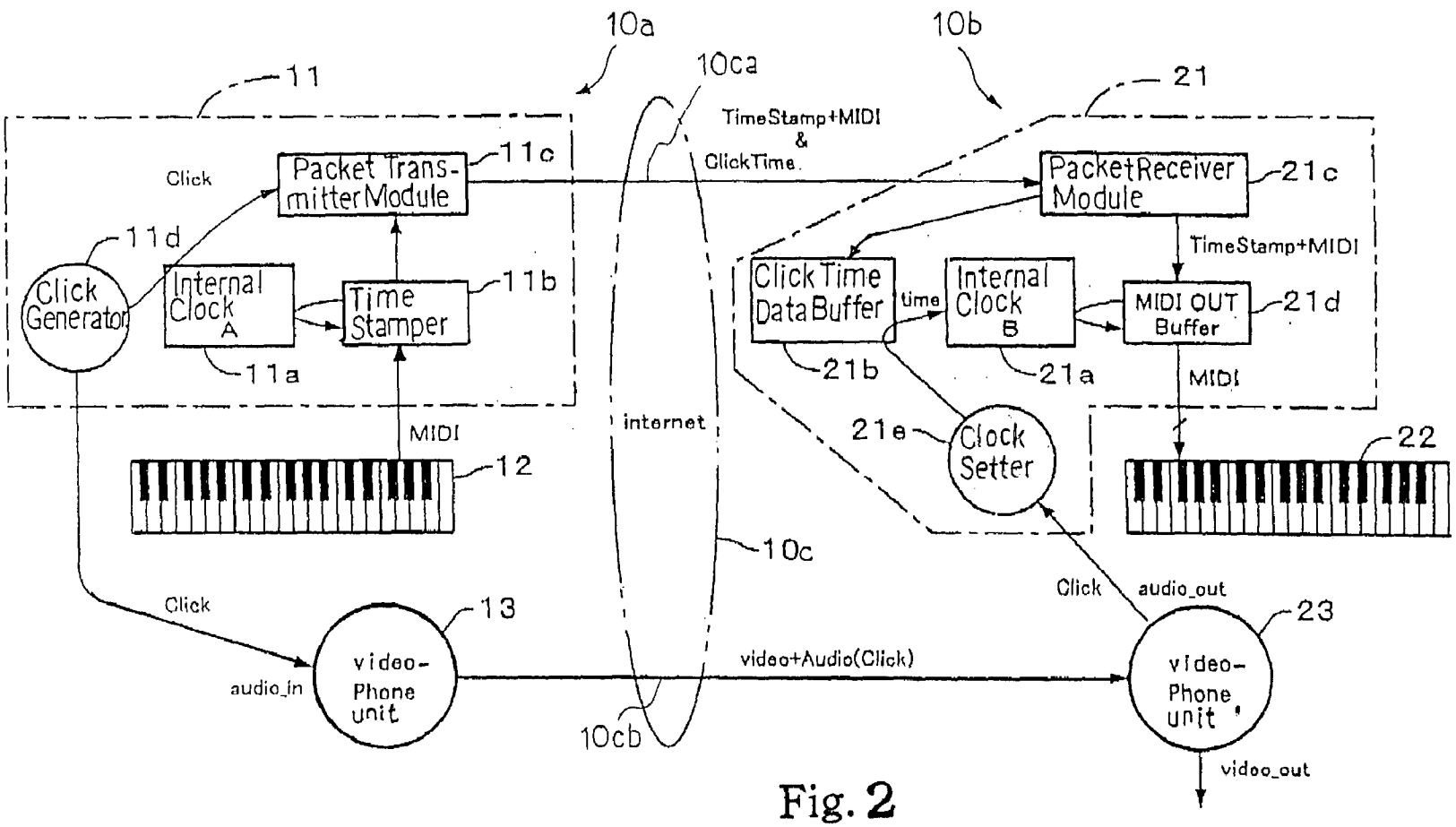
FIG. 2 is a block diagram showing the system configuration of a music performance system according to the present invention.

Referring to FIG. 2 of the drawings, a music performance system embodying the present invention largely comprises a master audio-visual station 10*a*, a slave audio-visual station 10*b* and communication channels 10*c*. The communication channel assigned to the MIDI music data, time stamp data and click time data is hereinafter referred to as "communication channel 10*ca*", and the other communication channel assigned to the audio-visual data and click data is hereinafter referred to as "communication channel 10*cb*". In this instance, the Internet serves as the communication channels 10*c*. The master audio-visual station 10*a* is communicable with the slave audio-visual station 10*b* through the communication channels 10*c*, and the MIDI music data/time stamp data/click time data and the audio-visual data/click data are independently transmitted from the master audio-visual station 10*a* to the slave audio-visual station 10*b* through the communication channels 10*c*. The slave audio-visual station 10*b* compares the click time data with the click data to see whether or not the data processing is well synchronized with the data generation in the master audio-visual station 10*a*. If the time difference is found, the slave audio-visual station 10*b* accelerates or retards the data processing on either MIDI music data or audio-visual data. Thus, the click data and click time data makes the master audio-visual station 10*a* and slave audio-visual station 10*b* synchronized with each other. The click data only expresses the fact that the click occurs. In other words, the click data is so simple that the slave audio-visual station 10*b* can clearly discriminate the occurrence of the click from the audio-visual data after the transmission through the communication channel 10*cb*. Even though the communication channel 10*cb* offers the base band data transmission to the videophone 13, the occurrence of the click is exactly reported to the slave audio-visual station 10*b*.

The audio-visual station 10*a* includes a controller 11, an electronic keyboard 12 and a videophone unit 13. In this instance, the controller 11 is implemented by a personal computer system, and includes a microprocessor, a program memory, a working memory and interfaces. However, these components are not shown in FIG. 2. The microprocessor selectively runs on appropriate application programs, and cooperates with other system components so as to achieve functions of an internal clock "A" 11*a*, a time stamper module 11*b*, a packet transmitter module 11*c* and a click generator module 11*d*.

The time stamper module 11*b* is connected to the electronic keyboard 12 and the internal clock 11*a*. MIDI music data codes are intermittently arrive at the time stamper module 11*b* during a performance on the electronic keyboard 12. When a MIDI music data code or codes arrive at the time stamper module 11*b*, the time stamper 11*b* fetches the time stamp data representative of the stamp time from the internal clock "A" 11*a*, and produces the time stamp data code. The MIDI music data code or codes are accompanied with the time stamp data code. Thus, the MIDI music data code or codes are stamped with the stamp time.

The click generator module 11*d* start to produce the click data at the initiation of the transmission of packets, and periodically produces the click time data codes. In other words, the click periodically occurs in the clock generator module. When the click occurs, the click generator module 11*d* fetches the click time from the internal clock "A" 11*a* so as to produce the click time data code, and further produces the click signal.

The packet transmitter module 11*c* is connected to the time stamper module 11*b* and click generator module 11*d*. The packet transmitter module 11*c* produces two sorts of packets. The packets of the first sort are assigned to the MIDI music data codes and associated time stamp data codes. On the other hand, the packets of the second sort are assigned to the click time data codes. The packets of the first sort are different in data bits in the header field from the packets of the second sort. Each packet of the first sort has data bits representative of the MIDI music data and associated time stamp data, i.e., the first sort together with the data bits representative of the addresses in the header field, and the music data codes and associated time stamp data codes are loaded in the payload data field. On the other hand, each packet of the second sort has the data bits representative of the click time data, i.e., the second sort together with the address bits in the header field, and the time stamp data code is loaded in the payload data field.

When the MIDI music data are stamped with the stamp time, the MIDI music data codes and associated time stamp data code are supplied from the time stamper module 11*b* to the packet transmitter module 11*c*, and are loaded in the payload field of the packet or packets. The packet or packets are delivered to the communication channels 10*c*, and are transmitted from the packet transmitter module 11*c* to the slave audio-visual station 21.

On the other hand, when the time stamp data code is produced, the time stamp data code is supplied from the click generator module 11*d* to the packet transmitter module 11*c*, and is loaded in the payload data field of the packet. The packet is delivered to the communication channels 10*c*, and is transmitted from the packet transmitter module 11*c* to the slave audio-visual station 21.

Figure 3:
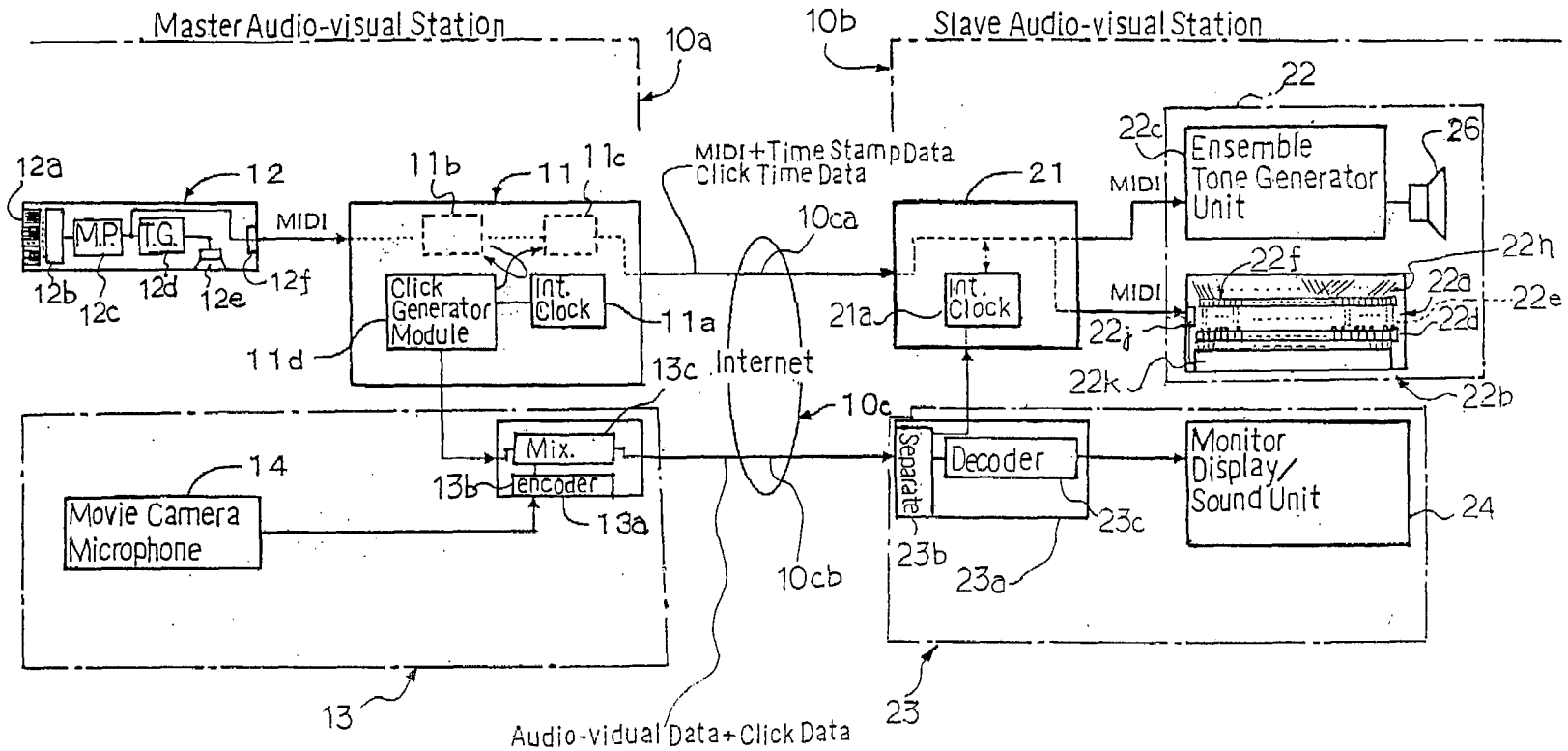
FIG. 3 is a block diagram showing the system configuration of videophone units incorporated in a master audio-visual station and a slave audio-visual station.

The electronic keyboard 12 includes a keyboard 12*a*, a key switch circuit 12*b*, a microprocessor unit 12*c*, a tone generator 12*d*, a sound system 12*e* and a MIDI port 12*f* as shown in FIG. 3. The key switch circuit 12*b* has plural key switches, which are connected to the black keys and white keys of the keyboard 12*a*. While a musician is fingering a piece of music on the keyboard 12*a*, the key switches selectively turn on and off, and produces key state signals representative of key-on state and key-off state. Though not shown in the drawings, a program memory, a working memory and other assistant circuits are connected to the microprocessor 12*c*, and the microprocessor 12*c* selectively runs on application programs stored in the program memory. The microprocessor unit 12*c* periodically scans the key switch circuit 12*b* to see whether or not the musician depresses and/or releases the black/white keys. When the microprocessor unit 12*c* notices the musician depressing and/or releasing the black/white keys, the microprocessor unit 12*c* produces voice messages, and are coded in the formats. Thus, the microprocessor units 12*c* produces the MIDI music data codes, and supplies the MIDI music data codes to the tone generator 12*d* and MIDI port 12*f*.

The tone generator 12*d* has plural channels and a waveform memory where waveform data are stored. The plural channels are respectively assigned to note-on events which are concurrently occur. The waveform data are accessed through the channels, and are read out from the waveform memory for producing a digital audio signal. The sound system 12*e* includes a digital-to-analog converter, amplifiers and loud speakers. The digital audio signal is converted to an analog audio signal, and the analog audio signal is supplied through the amplifiers to the loud speakers for producing electronic tones.

If the MIDI port 12*f* is connected through a MIDI cable to the time stamper module 11*b*, the MIDI music data codes are transmitted through the MIDI cable to the time stamper module 11*b*.

The videophone unit 13 includes a digital circuit 13*a* and a movie camera/microphone 14. At least an encoder 13*b* and a digital mixer 13*c* are incorporated in the digital circuit 13*a*. While a musician is performing the piece of music on the keyboard 12*a*, the movie camera/microphone 14 pick up the visual images and monophonic sound, and converts the images and monophonic sound to the analog audio-visual signal. The analog audio-visual signal is supplied from the movie camera/microphone 14 to the digital circuit 13*a*. The analog audio-visual signal is compressed and converted to the audio-visual data codes through the encoder 13*b*. The audio-visual data codes are transmitted from the digital circuit 13*a* to the slave audio-visual station 10*b* through the communication channel 10*cb* as a digital mixed signal.

Figure 4:
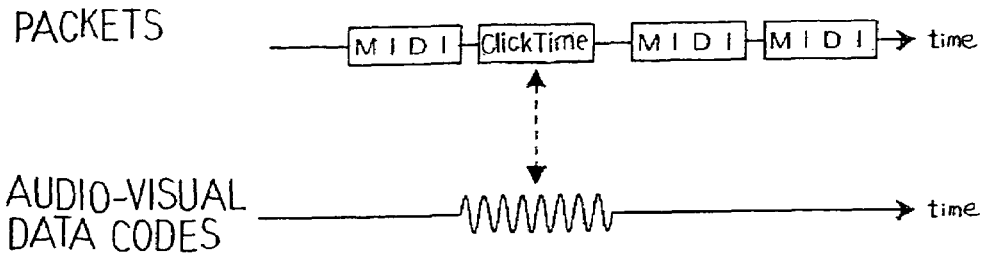
FIG. 4 is a graph showing a click time data code and a click signal synchronously delivered to different communication channels.

As described hereinbefore, the click signal, i.e., a predetermined pulse train is periodically produced in the click generator module 11*d*. The click signal is supplied from the click generator module 11*d* to the digital circuit 13*a*, and the click time data code is supplied from the clock generator module 11*d* to the packet transmitter module 11*c*. The click signal is mixed with the audio-visual data codes by means of the digital mixer 13*c*, and the digital mixed signal, which contains audio-visual data and click data, is transmitted through the communication channel 10*cb* to the slave audio-visual station 10*b*. On the other hand, the click time data code and MIDI music data codes are transmitted from the packet transmitter module 11*c* through the communication channel 10*ca* to the packet receiver module 21 in the form of packets. Although the different communication channels 10*ca* and 10*cb* are respectively assigned to the packets and the digital mixed signal, the digital mixed signal, which contains the click signal, and the packets, which contains the click time data code, are delivered to the communication channels 10*ca* and 10*cb* in such a manner that the click time data code and click signal arrive at the controller 21 almost concurrently. Thus, the click time data code is paired with the click signal as shown in FIG. 4. Even if a time difference occurs between the arrival of the click time data code and the arrival of the click signal, the controller 21 makes the click time data code paired with the corresponding click signal in so far as the time difference is fallen within a predetermined value.

Turning back to FIG. 2, the audio-visual station 10*b* includes a controller 21, an automatic player piano 22 and a video-phone unit 23. The controller 21 is also implemented by a personal computer system, and includes a microprocessor, a program memory, a working memory and interfaces. The microprocessor selectively runs on computer programs stored in a program memory (not shown), and achieves functions of an internal clock "B" 21*a*, a click time data buffer 21*b*, a packet receiver module 21*c*, a MIDI out buffer 21*d* and a clock setter module 21*e*.

The internal clock "B" 21*a* measures a lapse of time, and is set with the time stamp data. The time stamp data codes are temporarily stored in the clock time data buffer 21*b*, and the MIDI music data codes are accumulated in the MIDI out buffer 21*d*. The packets arrive at the packet receiver module 21*c*, and the packet receiver module 21*c* checks the header to see whether the payload is the MIDI music data codes/associated time stamp data code or the click time data codes. When the packet receiver module 21*c* decides that the payload is the MIDI music data code or codes and associated time stamp data code, the packet receiver module 21*c* transfers the MIDI music data code or codes and associated time stamp data code to the MIDI out buffer 21*d*, and the MIDI music data code or codes and associated time stamp data code are stored in the MIDI out buffer 21*d*. On the other hand, when the click time data code arrives at the packet receiver module 21*c*, the click time data code is transferred to the click time data buffer 21*b*, and is temporarily stored therein.

The clock setter 21*e* monitors the videophone unit 23, and checks the videophone unit 23 to see whether or not the click signal arrives thereat. While the videophone unit 23 is receiving the audio-visual data codes, the clock setter 21*e* stands idle. However, when the click signal arrives at the videophone unit 23, the clock setter 21*e* reads out the click time data code from the click time data buffer 21*b*, and sets the internal clock "B" 21*a* to the click time represented by the click time data code. The setting work will be hereinafter described in more detail.

Figure 5A:
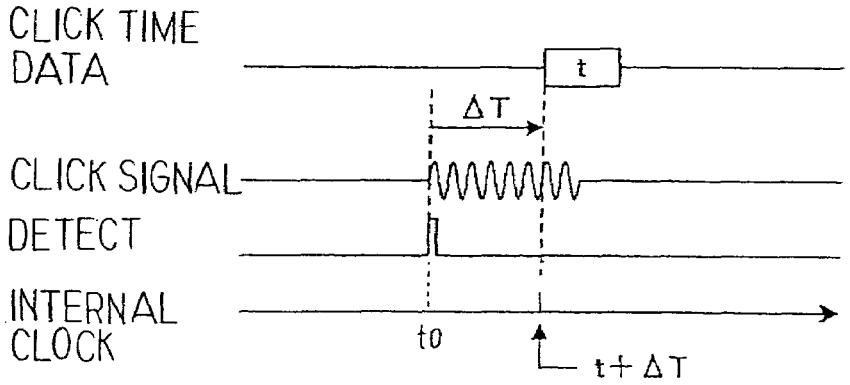
FIG. 5A is a timing chart showing a setting work on an internal clock.
Figure 5B:
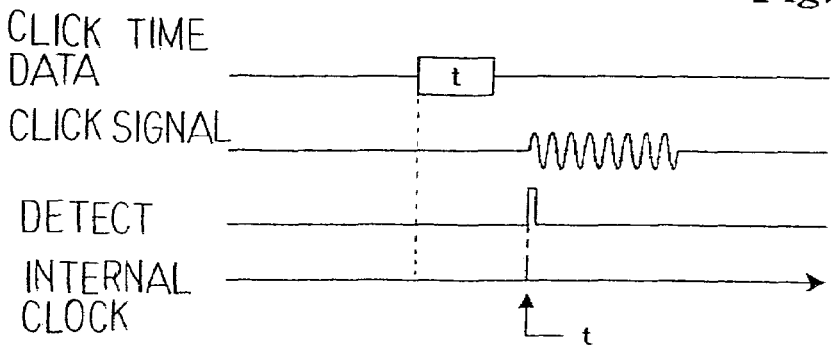
FIG. 5B is a timing chart showing another setting work on the internal clock.

As described in conjunction with FIG. 4, the click signal is paired with the click time data code in the controller 21 in so far as the time difference does not exceed the predetermined value. FIGS. 5A and 5B show the setting work on the internal clock 21*a*.

First, assuming now that the click signal arrives at the clock setter 21*e*, the clock setter 21*e* detects the click signal at time to as shown in FIG. 5A, and raises a detect signal. With the detect signal, a timer starts to measure a lapse of time from time t0. When the timer indicates that the lapse of time is ÄT, the click time data code reaches the click time data buffer 21*b*, and the click time data code points to "t". If the lapse of time ÄT is shorter than the predetermined time period, the clock setter 21*e* makes the click signal paired with the click time data code, and adds the lapse of time ÄT to the click time "t". The clock setter 21*e* sets the internal clock "B" 21*a* to "t+ÄT".

If the click time data code firstly reaches the click time data buffer 21*b* at "t" as shown in FIG. 5B, the clock setter 21*e* starts the timer. The click time data code points to "t". The clock setter 21*e* waits for the click signal, and the click signal arrives at the clock setter 21*e* when the timer points to "ÄT". The clock setter 21*e* raises the detect signal, and checks the timer to see whether or not the lapse of time "ÄT" is shorter than a predetermined time period. If the answer is given affirmative, the clock setter 21*e* makes the click time data code paired with the click signal, and sets the internal clock "B" 21*a* to time "t".

If the lapse of time "ÄT" is longer than the predetermined time periods, the clock setter 21*e* stops the setting work, and eliminates the click time data code, which has already arrived, from the click time data buffer 21*b*. Thus, the clock setter 22*e* measures the lapse of time "ÄT" by using a timer. In this instance, the timer is implemented by a software counter. Since the click signal has a constant pulse period, the lapse of time "ÄT" is given as the number of the pulses.

A delay time may be unintentionally introduced during the propagation through the communication channel 10*cb*, and the packets are also delayed in the propagation through the communication channel 10*ca*. The delay times are to be taken into account. The amount of delay is depending upon the communication channels 10*ca* and 10*cb*.

The click time data code is transmitted from the master audio-visual station 10*a* to the slave audio-visual station 10*b* through the packet switching network 10*ca*, and the delay time is usually fallen within the range from 10 milliseconds to 100 milliseconds.

In case where the click signal is transmitted through the television conference system, the delay time is estimated at 200 milliseconds to 300 milliseconds. If the click time data code arrives at the slave audio-visual station 10*b* earlier than the click signal (see FIG. 5B), the delay is the difference between the maximum delay of the click signal and the minimum delay of the click time data code, and a margin "á", which is tens milliseconds to 200 milliseconds, is added to the difference. As a result, the predetermined time period is (300+á) milliseconds. If the click signal arrives at the slave audiovisual station 10*b* earlier than the click time data code (see FIG. 5A), the packet is delayed over the maximum delay, and such a serious delay is unusual. The packet switching network 10*ca* is assumed to permit the packets to be delayed of the order of 300 milliseconds. Then, the predetermined time period is the difference between 300 milliseconds and the minimum delay of the click signal, and is of the order of 100 milliseconds. Otherwise, the clock setter 21*e* may recommend the master audio-visual station to stop the data transmission to the slave audio-visual station 10*b*

On the other hand, in case where the click signal is transmitted through the streaming system 10*cb*, the delay is estimated at 15 seconds to 30 seconds. The delay through the streaming system is much longer than the delay through the video conference system. For this reason, the setting work is focused on the delay of the click signal. The predetermined time period is the difference between the minimum delay of the click time data code and the maximum delay of the click signal, and a margin â, which is several seconds, is also added to the difference. The predetermined time period is estimated at 30+â. If the click signal arrives at the slave audio-visual station 10*b* without any associated click time data code, the controller 21 decides that the master audio-visual station 10*a* fails to transmit the MIDI music data and click time data. In other words, the predetermined time period for the delay of the click time data code is zero. The predetermined time period in the delay of the click time data code is hereinafter referred to as "predetermined time period A", and the predetermined time period in the delay of the click signal is hereinafter referred to as "predetermined time period B".

The margins á and â are indicative of the possible delay of the click signal when the load to the communication channel 10*cb* is rapidly increased.

As described in connection with the click generator module 11*d*, the clicks periodically occur, and the click signal is repeatedly supplied to the videophone unit 13. The delay times are taken into account in the design work on the click generator module 11*d*. In case where the television conference system is employed in the music performance system, the time intervals of the clicks may be optimized around 2 seconds on the condition that the usual delay time of the click signal ranges from 200 milliseconds to 300 milliseconds as described hereinbefore. It is recommendable that the predetermined time period B and predetermined time period A are of the order of 0.5 second and 0.1 second. On the other hand, in case where the streaming system is employed in the music performance system, the time intervals of the clicks may be optimized around 30 seconds on the condition that the delay of the click signal is estimated at 5 seconds to 20 seconds. It is recommendable that the predetermined time period B and predetermined time period A are of the order of 25 seconds and zero.

Turning to FIG. 3 of the drawings, again, the automatic player piano 22 includes an acoustic piano 22*a*, an automatic player 22*b*, an ensemble tone generator unit 22*c* and a sound system 26. Since the automatic player 22*b*, ensemble tone generator unit 22*c* and sound system 26 are installed inside the acoustic piano 22*a*, the automatic player piano 22 has an external appearance like a standard acoustic piano. The automatic player 22*b* is responsive to the MIDI music data codes so as to produce acoustic piano tones. The ensemble tone generator unit 22*c* is also responsive to the MIDI music data codes so as to produce electronic tones or beat sound in ensemble with the acoustic piano 22*a*.

The acoustic piano 22*a* includes a keyboard 22*d*, action units 22*e*, hammers 22*f* and strings 22*h*. Black and white keys form parts of the keyboard 22*d*, and are respectively connected to the action units 22*e*, respectively. The action units 22*e* are respectively coupled with the hammers 22*f*, and the hammers 22*f* are opposed to the strings 22*h*, respectively. While a pianist is fingering on the keyboard 22*d*, the action units 22*e* are selectively actuated with the depressed keys, and cause the associated hammers 22*f* to be driven for rotation through escape so that the strings 22*h* are struck with the hammers at the end of the free rotation. Thus, the strings 22*h* vibrate for producing the acoustic piano tones.

The automatic player 22*b* includes a controller 22*j* and solenoid-operated key actuators 22*k*. The controller 22*j* analyzes the MIDI music data codes, and determines trajectories, on which the black/white keys are to be moved, through the analysis. On the other hand, the solenoid-operated key actuators 22*k* are provided under the keyboard 22*d*, and are selectively energized with a driving signal so as to move the associated black/white keys along the trajectories. The key motion gives rise to the actuation of the action units 22*e* so that the hammers 22*f* are driven for the rotation as if the pianist selectively depresses and releases the black and white keys. The strings 22*h* are also struck with the hammers 22*f*, and vibrate for producing the acoustic piano tones.

The videophone unit 23 includes a digital circuit 23*a* and a monitor display/sound unit 24. The digital circuit 23*a* receives the digital mixed signal, which contains the click data and audio-visual data, and selectively transfers the audio-visual codes and click signal to the monitor display/sound unit 24 and controller 21. The digital circuit 23*a* has at least a separator 23*b* and a decoder 23*c*. The click signal is separated from the digital mixed signal, and is supplied to the controller 21. The residue, i.e., the audio-visual data codes are supplied to the decoder 23*c*, and are decoded to the digital audio-visual signal. The digital audio-visual signal is supplied to the monitor display/sound unit 24, and is converted through the monitor display/sound unit 24 to the visual images on the display screen and monophonic sound through the loud speakers.

System Behavior

Figure 6:
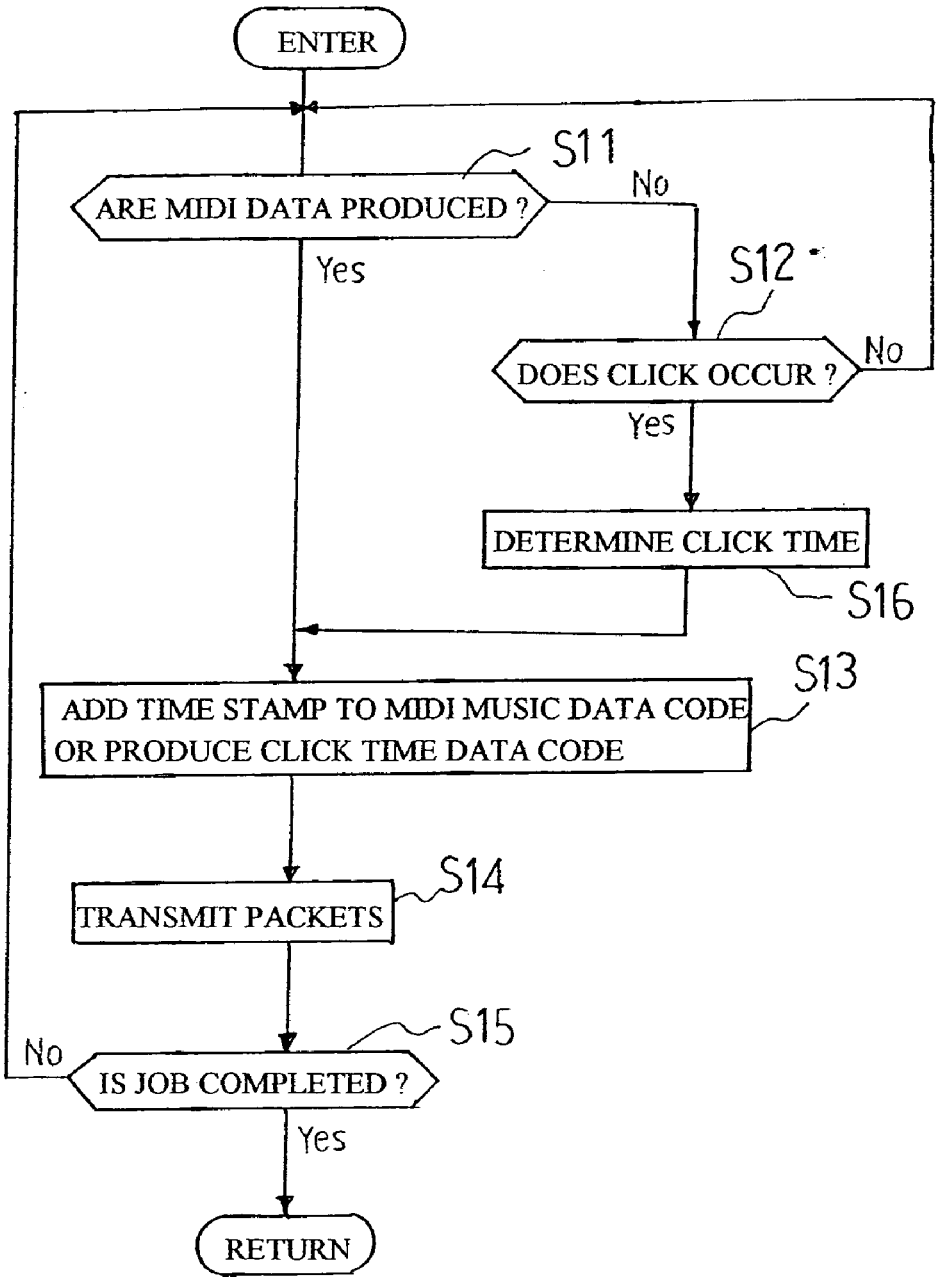
FIG. 6 is a flowchart showing a computer program on which a microprocessor of the master audio-visual station runs.
Figure 7A:
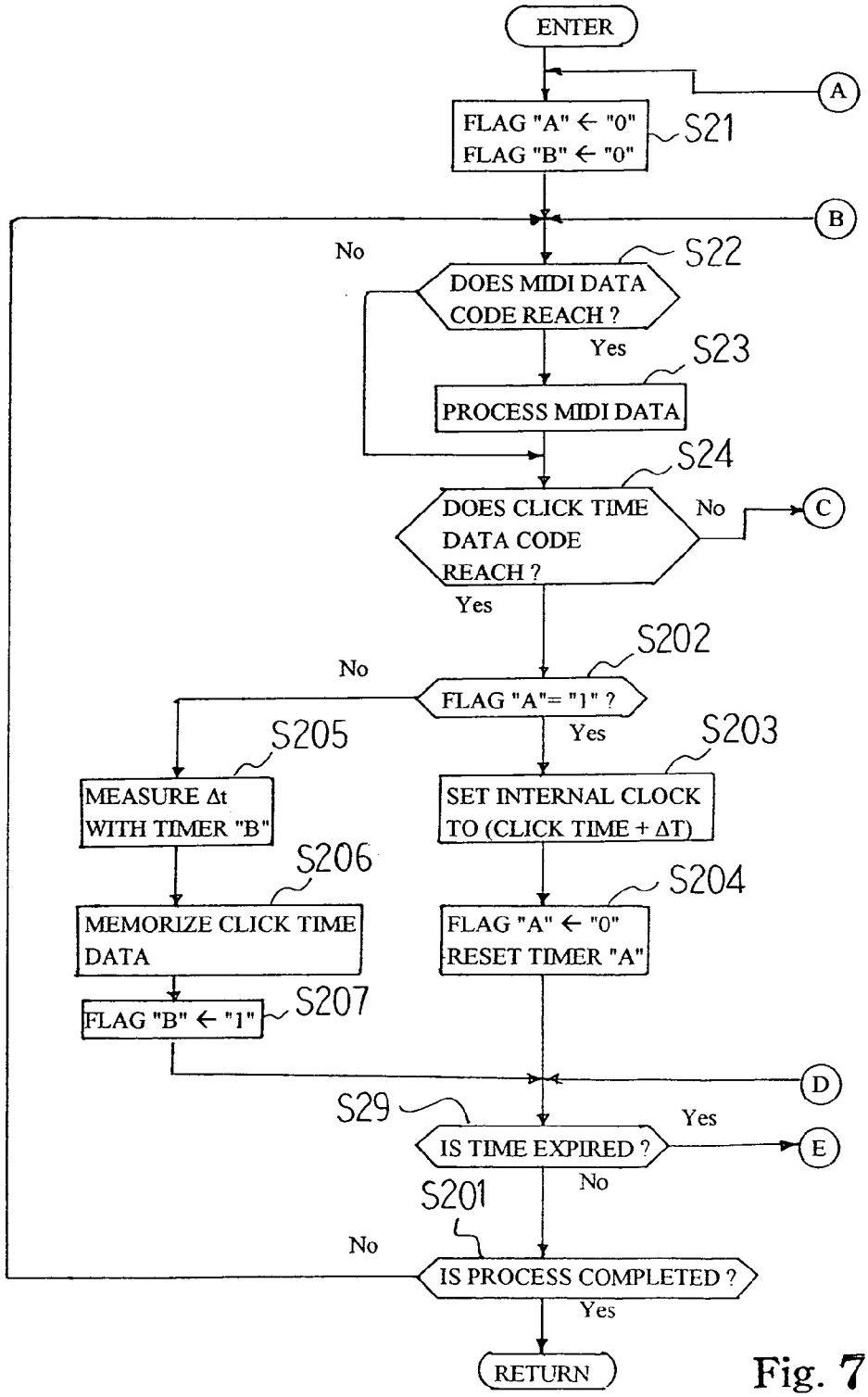
FIGS. 7A and 7B are flowcharts showing a computer program on which a microprocessor of the slave audio-visual station runs.
Figure 7B:
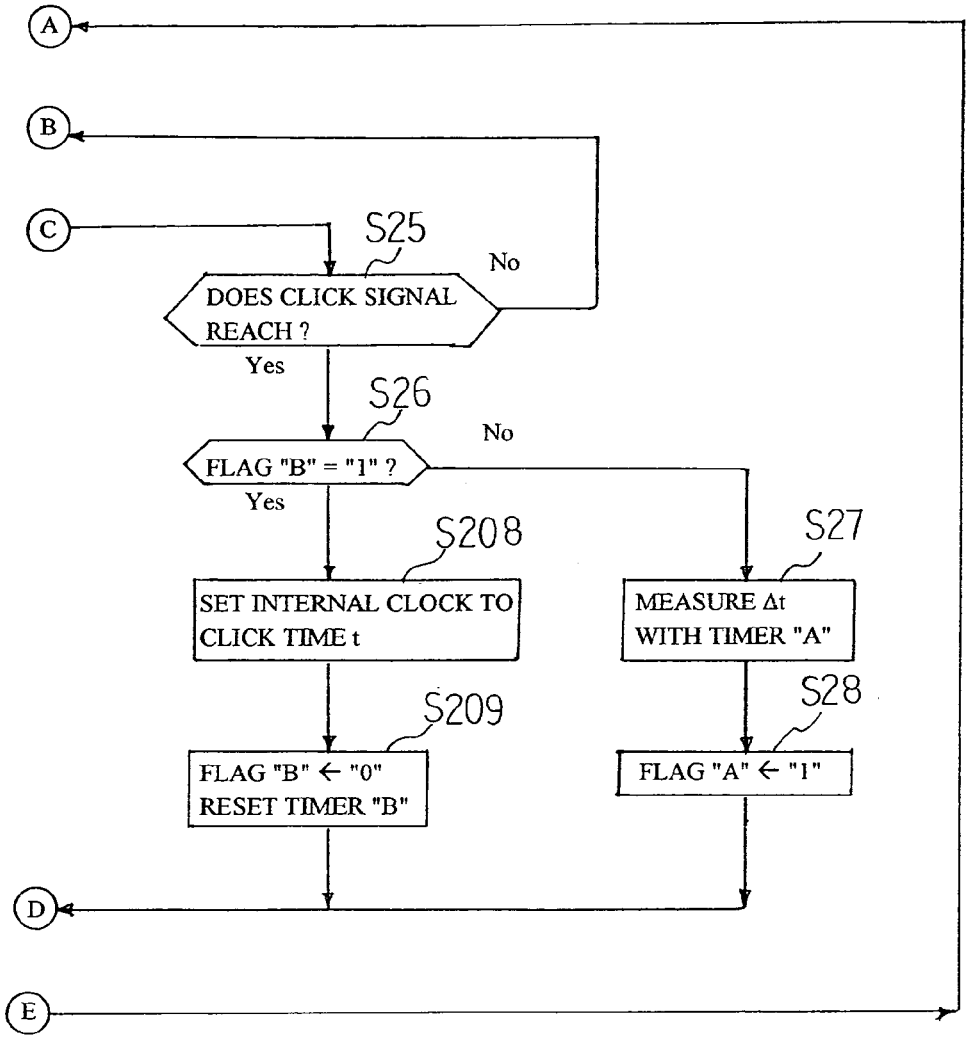

Description is hereinafter made on a remote concert. A pianist sits on a stool in front of the electronic keyboard in the master audio-visual station 10*a*, and the movie camera/microphone 14 are directed to the pianist. A large audience is gathered in the slave audio-visual station 10*b*, and a wide television set is prepared in the slave audio-visual station 10*b* as the monitor display/sound unit 24. FIG. 6 shows a computer program on which the microprocessor of the controller 11 runs. On the other hand, FIGS. 7A and 7B show a computer program on which the microprocessor of the other controller 21 runs.

The pianist gets ready for his or her performance, and the controller 11 starts to transmit the packets and digital mixed signal to the slave audio-visual station 10*b*. The internal clock "A" 11*a* starts to measure the lapse of time, and the click generator module 11*d* produces the clicks at the time intervals. The microprocessor of the controller 11 enters the computer program shown in FIG. 6, and the videophone unit 13 transmits the digital mixed signal through the communication channel 10*cb* to the videophone unit 23. The controller 21 also gets ready to produce the acoustic piano tones and visual images. The microprocessor of the controller 21 starts to run on the computer program shown in FIGS. 7A and 7B. The click is assumed to occur between a key-on event and a key-off event.

While the microprocessor reiterates the loop consisting of step S11 to S16, the pianist depresses a white key, and releases the white key. The microprocessor returns to step S11 immediately before the pianist depresses the white key. The microprocessor checks the MIDI port to see whether or not a MIDI music data code reaches there as by step S11. The microprocessor 12*c* of the electronic keyboard 12 has transferred the MIDI music data codes representative of the note-on to the MIDI port of the controller 11. The microprocessor acknowledges the MIDI music data codes, and the answer at step S11 is given affirmative.

With the positive answer at step S11, the microprocessor proceeds to step S13. The microprocessor fetches the stamp time from the internal clock "A" 11*a*, and produces the stamp time data code. Thus, the microprocessor stamps the MIDI music data codes with the time stamp at step S13.

Subsequently, the microprocessor loads the MIDI music data codes and time stamp data code in the data field of packets assigned to the payload, and transmits the packets from the transmitter through the communication channel 10*ca* to the packet receiver module 21*c* as by step S14.

Subsequently, the microprocessor checks the signal port (not shown) assigned to instruction signals to see whether or not an operator instructs the controller 11 to return to the main routine program as by step S15. The pianist continues his or her performance. For this reason, the answer at step S15 is given negative, and the microprocessor returns to step S11.

The microprocessor checks the MIDI port, again, to see whether or not the next MIDI music data code arrives there at step S11. However, the next MIDI music data code does not reach the MIDI port. Then, the answer at step S11 is given negative, and the microprocessor checks the data port assigned to the click time data code to see whether or not the click occurs as by step S12. While the time is passing toward the next click, the answer at step S12 is given negative. With the negative answer, the microprocessor returns to step S11, and reiterates the loop consisting of steps S11 and S12 until the answer at step S11 or S12 is changed to affirmative.

The click occurs. Then, the answer at step S12 is changed to affirmative. The microprocessor proceeds to step S16, and fetches the click time from the internal clock "A" 11*b*. The microprocessor proceeds to step S13, and produces the click time data code. The microprocessor loads the click time data code in the data field of the packet assigned to the payload, and transmits the packet through the communication channel 10*ca* to the packet receiver module 21*c* at step S14.

The microprocessor checks the signal port assigned to the instruction signal to see whether or not the operator instructs the controller 11 to stop the data processing at step S15. With the negative answer at step S15, the microprocessor returns to step S11, and checks the MIDI port to see whether or not the MIDI music data code reaches there. The key-off event occurs immediately before the completion of the job at step S15. The answer at step S11 is given affirmative. Then, the microprocessor fetches the stamp time from the internal clock "A" 11*b*, and stamps the MIDI music data code representative of the note-off with the stamp time at step S13. The microprocessor loads the MIDI music data code and associated time stamp data code in the data field of the packet, and transmits the packet through the communication channel 10*ca* to the packet receiver module 21*c*.

If the pianist continues his or her performance, the answer at step S15 is given negative, and the microprocessor returns to step S11. Thus, the microprocessor reiterates the loop consisting of steps S11 to S16 so that the MIDI music data codes/stamp time data code and the click time data code are transmitted through the communication channel 10*ca* to the packet receiver module 21*c*.

After the pianist completes his or her performance, the operator instructs the controller 11 to stop the data processing. Then, the answer at step S15 is given affirmative, and the microprocessor returns to the main routine program.

While the microprocessor of the controller 11 is running on the computer program shown in FIG. 6, the MIDI music data codes/stamp time data codes and the click time data codes intermittently arrive at the packet receiver module 21*c*, and the digital mixed signal reaches the videophone unit 23 independently of the MIDI music data codes/stamp time data codes/click time data codes.

An operator has instructed the controller 21 to process the MIDI music data codes/stamp time data codes/click time data codes, and the microprocessor of the controller 21 reiterates the loop consisting of steps S21 to S29 and S201 to S209.

Thus, the microprocessor reiterates the loop consisting of steps S11 to S16 so that the controller 11 transmits the MIDI music data codes/time stamp data codes and click time data codes through the communication channel 10*ca* to the packet receiving module 21*c* in parallel to the transmission of the digital mixed signal to the videophone unit 23.

The MIDI music data code representative of the note-on, click time data code and MIDI music data code representative of the note-off are dealt with in the controller 21 as follows. In the following description, "flag A" and "timer A" are prepared for the delay of the click time data code shown in FIG. 5A, and "flag B" and "timer B" are for the delay of the click signal shown in FIG. 5B.

When an operator instructs the controller 21 to timely produce the acoustic piano tones through the automatic player piano 22, the microprocessor enters the computer program shown in FIGS. 7A and 7B. The computer program periodically branches into a time interruption sub-routine program, and selectively transfers the MIDI music data codes/associated time stamp data codes and click time data codes to the MIDI out buffer 21*d* and click time data buffer 21*b*.

The microprocessor firstly takes down or resets the flags "A" and "B" as by step S21. Subsequently, the microprocessor checks the MIDI out buffer 21*d* to see whether or not a MIDI music data code and associated time stamp data code have been stored there as by step S22. Any MIDI music data code does not reach the packet receiver module 21*c* before the pianist starts his or her performance, and the answer at step S22 is given negative. Then, the microprocessor proceeds to step S24, and checks the click time data buffer 21*b* to see whether or not a time stamp data code has been already stored there as by step S24. The time stamp data code does not reach the packet receiver module 21*c* immediately after the click generator module 11*d* starts to produce the clicks, and the answer at step S24 is given negative.

With the negative answer, the microprocessor proceeds to step S25 through the node C, and checks the clock setter 21*e* to see whether or not the click signal has reached there as by step S25. Since the click time data code has not reached the packet receiver module 21*d*, yet, it is natural that the answer at step S25 is given negative. Then, the microprocessor returns to step S22 through the node B. Thus, the microprocessor reiterates the loop consisting of steps S22, S24 and S25, and waits for the MIDI music data code/associated time stamp data code, click time data code and click signal.

The MIDI music data code representative of the note-on is assumed to reach the packet receiver module 21*c*. The MIDI music data code and associated time stamp data code are stored in the MIDI out buffer 21*d*, and the answer at step S22 is changed to positive. With the positive answer, the microprocessor compares the stamp time with the internal clock "B" 21*a* to see whether or not the MIDI music data code is to be transferred to the automatic player piano 22. When the internal clock "B" 21*a* points to the stamp time, the microprocessor transfers the MIDI music data code to the controller 21*j*, and the MIDI music data code is processed as by step S23.

In detail, the controller 22*j* determines the trajectory for the white key with the key code identical with that in the MIDI music data code, and supplies the driving signal to the associated solenoid-operated key actuator 22*k*. The driving signal makes the solenoid-operated key actuator 22*k* energized so that the plunger, which forms a part of the solenoid-operated key actuator 22*k*, starts to push the rear portion of the white key, upwardly. The white key actuates the action unit 22*e*, and the action unit 22*e* drives the associated hammer 22*f* for rotation. The hammer 22*f* is brought into collision with the associated string 22*h* at the end of the rotation, and gives rise to the vibrations of the string 22*h*. The acoustic piano tone is radiated from the vibrating string 22*h*. The controller 22*j* continuously energizes the solenoid-operated key actuator 22*h* so as to keep the white key at the end position.

Subsequently, the microprocessor checks the click time data buffer 21*b* to see whether or not the click time data code has been stored there at step S24, and checks the clock setter 21*e* to see whether or not the click signal has reached there at step S25. There are two possibilities. The first possibility is that the click time data code is delayed from the click signal (see FIG. 5A), and the second possibility is the delay of the click signal (see FIG. 5B).

The click time data code is assumed to be delayed. In this situation, the answer at step S24 is given negative, and the answer at step S25 is given affirmative. Then, the microprocessor checks the flag "B" to see whether or not the flag "B" has been raised as by step S26. Since the flag "B" is raised in the second possibility, the answer at step S26 is given negative, and the microprocessor starts the timer "A" to measure the lapse of time Ät as by step S27. The microprocessor raises the flag "A" as by step S28, and proceeds to step S29 through the node D. The microprocessor checks the timer "A" to see whether or not the lapse of time reaches the predetermined time period "A" at step S29. Since the timer "A" started to measure the lapse of time only two steps before step S29, the answer at step S29 is given negative, and the microprocessor checks the data port assigned to the instruction signal to see whether or not the operator instructs the controller 21 to stop the data processing as by step S201. The white key has been kept depressed as described in connection with step S23, and the answer at step S201 is given negative. Then, the microprocessor returns to step S22, and reiterates the loop consisting of steps S22, S24, S25 to S29 and S201 until the click time data code reaches the click time data buffer 21*b*. Of course, while the microprocessor is reiterating the loop, the next MIDI music data code may be stored in the MIDI out buffer 21*d*. If so, the answer at step S22 is changed to positive, and the MIDI music data code is processed as described in conjunction with step S23.

While the microprocessor is reiterating the loop consisting of steps S22, S24, S25 to S29 and S201, the click time data code reaches the packet receiver module 21*c* before the expiry of the predetermined time period "A". The click time data code is stored in the click time data buffer 21*b*. Then, the answer at step S24 is given affirmative. The microprocessor checks the flag "A" to see whether or not the click signal reached the slave audio-visual station 10*b* earlier than the click time data code did as by step S202. In the first possibility, the click time data code is delayed. Then, the answer at step S202 is given affirmative. The microprocessor adds the lapse of time Ät to the click time, and sets the internal clock "B" 21*a* to the sum, i.e., (click time+Ät) as by step S203. In other words, the microprocessor or clock setter 21*e* makes the internal clock "B" 21*a* periodically set with the internal clock "A" 11*a*, and keeps the transmission through the communication channel 10*ca* synchronized with the transmission through the other communication channel 10*cb*. This results in that the audio-visual data codes are synchronized with the MIDI music data codes.

Subsequently, the microprocessor takes down the flag "A", and resets the timer "A" as by step S204. The microprocessor returns to step S22 through steps S29 and S201.

On the other hand, if the lapse of time Ät exceeds the predetermined time period "A", the microprocessor returns to step S21 through the nodes E and A, and resets the flag "A". This means that the microprocessor does not carry out the setting work.

The click time data code is assumed to reach the packet receiver module 21*c* earlier than the click signal, i.e., the second possibility occurs. When the microprocessor checks the click time data buffer 21*b* for the click time data code, the answer is given affirmative. The microprocessor checks the flag "A" to see whether or not the click signal has reached the clock setter 21*e* before the click time data code as by step S202. The answer is given negative in the second possibility. The microprocessor starts the timer "B" to measure the lapse of time Ät as by step S205, and memorizes the click time in the internal register thereof as by step S206. Subsequently, the microprocessor raises the flag "B" as by step S207, and compares the lapse of time Ät with the predetermined time period "B" to see whether or not the lapse of time Ät exceeds the predetermined time period "B" at step S29. While the answer at step S29 is being given negative, the microprocessor returns to step S22 through steps S201, and reiterates the loop consisting of steps S22, S24 and S25. Of course, if a MIDI music data code/associated time stamp data code reach the MIDI out buffer 21*d*, the microprocessor timely transfers the MIDI music data code to the automatic player piano 22 as described in conjunction with step S23.

The click signal reaches the clock setter 21*e*. Then, the answer at step S25 is changed to affirmative, and the microprocessor checks the flag "B" to see whether or not the click time data code reached the click time data buffer 21*b* before the click signal. In the second possibility, the answer at step S26 is given affirmative (see step S207), and the microprocessor S208 sets the internal clock "B" 21*a* to the click time as by step S208 as the clock setter 21*e*. Thus, the microprocessor or clock setter 21*e* periodically makes the internal clock "B" 21*a* set with the internal clock "A" 11*a*, and keeps the transmission through the communication channel 10*ca* synchronized with the transmission through the other communication channel 10*cb*. This means that the audiovisual data codes are received by the videophone unit 23 also synchronously with the MIDI music data codes/associated time stamp data codes.

Subsequently, the microprocessor takes the flag "B" down, and resets the timer "B" as by step S209. The microprocessor passes through steps S29 and S201, and returns to step S22.

If, on the other hand, the click signal does not reach the clock setter 21*e* before the expiry of the predetermined time period "B", the answer at step S29 is changed to the positive, and the microprocessor returns to step S21 through the nodes E and A. The microprocessor resets both flags "A" and "B", and reiterates the loop consisting of steps S22 to S29 and S201 to S209, again.

While the microprocessor is reiterating the loop, the MIDI music data code representative of the note-off and associated time stamp data code arrive at the packet receiver module 21*c*, and are stored in the MIDI out buffer 21*d*. Then, the answer at step S22 is given affirmative, and the microprocessor S23 compares the stamp time with the internal clock "B" 21*a* to see whether or not the MIDI music data code is transferred to the automatic player piano 22. As described hereinbefore, the internal clock "B" is periodically set with the internal clock "A" 11*a* through the comparison between the click signal and the click time data codes. Although a time delay, which is due to the transmission through the communication channels 10*c*, is unavoidable on the internal clock "B" 21*a*, the lapse of time between the MIDI music data codes in the master audio-visual station 10*a* is approximately equal to the lapse of time between the same MIDI music data codes in the slave audio-visual station 10*b*.

When the time comes, the microprocessor transfers the MIDI music data code representative of the note-off to the controller 22*j*. The controller 22*j* acknowledges the note-off, and decays the driving signal. Then, the electric power is removed from the solenoid-operated key actuator 22*k*, and the plunger is retracted. As a result, the white key returns to the rest position, and the damper takes up the vibrations on the way to the rest position. This results in the decay of the acoustic piano tone.

The videophone unit 13 has transmitted the audio-visual data codes representative of the visual image of the key motion through the communication channel 10*cb* to the videophone unit 23. The audio-visual data codes are supplied to the wide television set 24, and the key motion is reproduced on the television screen concurrently with the decay of the acoustic piano tone. Thus, the performance and visual images are synchronously produced in the slave audio-visual station 10*b* by virtue of the setting work on the internal clock "B" 21*a*.

As will be appreciated from the foregoing description, the clock setter 21*e* periodically sets the internal clock "B" with the sum of the click time and the time difference between the transmission through the communication channel 10*ca* and the transmission through the other communication channel 10*cb*. Even though the MIDI music data codes and audio-visual data codes are transmitted from the master audio-visual station 10*a* to the slave audio-visual station 10*b* through the communication channels 10*ca* and 10*cb* independently of each other, the MIDI music data codes and audio-visual images are synchronously reproduced in the slave audio-visual station. Thus, the audiences enjoy the concert remote therefrom as if they are staying around the pianist.

The click signal is the simple pulse train so that the videophone unit 13 can transmit the click signal through the base band communication without missing the timing information.

Although the particular embodiment of the present invention has been shown and described, it will be apparent to those skilled in the art that various changes and modifications may be made without departing from the spirit and scope of the present invention.

For example, the master audio-visual station 10*a* may be connected to the slave audio-visual station 10*b* through leased lines or a private communication network instead of the Internet 10*c*.

Audio-visual data may be bi-directionally transmitted between the master audio-visual station 10*a* and the slave audio-visual station 10*b*. In this instance, visual images and voice in the slave audio-visual station 10*b* are produced through loud speakers and monitor display in the master audio-visual station.

The music performance system according to the present invention is available for the remote lessons.

The electronic keyboard 12 may be replaced with another sort of electronic musical instrument such as, for example, an electronic percussion instrument or instruments, an electronic stringed musical instrument, an electronic wind instrument or an electronic percussion instrument. The automatic player piano 22 may be also replaced with an electronic keyboard, an electronic percussion instrument or instruments, another sort of electronic musical instrument or a stereo set.

The MIDI music data codes and audio-visual data may be recorded before the remote concert or remote lesson. In this instance, the electronic keyboard 12 and movie camera/microphone are replaced with a suitable information storage medium such as, for example, a compact disk, a hard disk or a floppy disk.

In case where the communication channel 10*cb* is implemented by the streaming system, which has a right channel and a left channel for stereophonic tones, the monophonic sound and click signals may be assigned to the two channels, respectively.

In case where the monophonic sound is transmitted through the television conference system as similar to the above-described embodiment, a low-frequency signal such as 40 Hz may be available for the click signal, because the audio signal seldom contains such a low-frequency signal. In this instance, the low-frequency signal may be separated from the audio-visual signal by means of a low-pass filter.

In the embodiment described hereinbefore, the timer "A" and timer "B" are implemented by a software counter, because the pulse period has been already known. However, a pulse train with unknown pulse period is available for the timers "A" and "B". In this instance, the clock setter 21*e* determines the pulse period on the basis of several pulses.

In the embodiment described hereinbefore, the click signal or predetermined pulse train is mixed with the audio-visual data codes. In another embodiment, the click signal may be mixed with the digital audio-visual signal, and the mixture is converted to the audio-visual signal through the compression and encoding.

The waveform shown in FIG. 4 does not set any limit to the technical scope of the present invention. Any periodic signal or any isolated signal is available for the clicks in so far as the periodic signal or isolated signal is discriminative from the digital signal representative of the audio-visual data. For example, a signal with a predetermined duty ratio may be used as the click signal.

The timers "A" and "B" do not set any limit to the technical scope of the present invention. Each click time data code may be paired with the click signal on the basis of the lapse of time from the previous click time data code and the lapse of time from the previous click signal.

The two communication channels do not set any limit to the technical scope of the present invention. More than two communication channels may be used in the separate-type music performance system according to the present invention. In this instance, the clock setter 21*e* makes three data signals grouped so as to make these data signals synchronized with one another.

The MIDI protocols do not set any limit to the technical scope of the present invention. In other words, pieces of music data may be coded in other format defined in another sort of protocols.

Claim languages are correlated with the terms used in the description of the preferred embodiment as follows. The MIDI music data, time stamp data, click time data, click data and audio-visual data are corresponding to "pieces of music data", "pieces of first timing data", "pieces of second timing data", "pieces of periodical data" and "pieces of visual data", respectively. The figure of visual images in the moving picture is corresponding to "attribute". However, colors of the visual images, colors of light beams may be another attribute. The click serves as "sign of a time period", because the click is generated in each regular time interval. The master audio-visual station and slave audio-visual station serve as "first audio-visual station" and "second audio-visual station", respectively.

The electronic keyboard 12 and packet transmitter module 11*c* as a whole constitute "music data source", and the videophone unit 13 serves as "video data source". The internal clock "A" 11*a*, time stamper module 11*b* and click generator module 11*d* as a whole constitute "time keeper". The internal clock "B" 21*a* serves as "internal clock". The automatic player piano 22 is corresponding to "music sound generator", and the videophone 23 serves as "visual image generator".

What is claimed is:

1. A music performance system for synchronously producing music sound and visual images, comprising:

plural communication channels independently of one another, and selectively assigned pieces of music data representative of music sound, pieces of first timing data representative of respective occurrences of said pieces of said music data, pieces of periodical data each representative of a sign of a time period, pieces of second timing data representative of respective occurrences of said pieces of periodical data and pieces of visual data representative of at least an attribute of visual images for propagating therethrough without any guarantee of a time consumed in the propagation;

a first audio-visual station including a music data source outputting said pieces of music data together with the associated pieces of first timing data and said pieces of second timing data to one of said plural communication channels, a visual data source outputting said pieces of visual data and said pieces of periodical data to said another of said plural communication channels, a time keeper producing said pieces of periodical data at regular intervals, connected to said music data source and said visual data source and determining a first time at which each of said pieces of music data occurs and a second time at which each of said pieces of periodical data occurs, thereby selectively supplying said pieces of first timing data, said pieces of second timing data and said pieces of periodical data to said music data source and said visual data source; and a second audio-visual station connected to said plural communication channels so as to receive said pieces of music data, said pieces of first timing data, said pieces of periodical data, said pieces of second timing data and said pieces of visual data, and including an internal clock measuring a third time asynchronously with said time keeper, a clock setter pairing said pieces of second timing data with the associated pieces of periodical data to see whether or not a time difference between arrivals thereat is ignoreable, and setting said internal clock right on the basis of said pieces of second timing data and said time difference if said time difference is not ignoreable, a visual image generator supplied with said pieces of visual data so as to produce said visual images and a music sound generator comparing said pieces of first timing data with said third time so as to produce said music sound synchronously with said visual images.

2. The music performance system as set forth in claim 1, in which said plural communication channels are established in an internet.

3. The music performance system as set forth in claim 2, in which said one of said plural communication channels propagates said pieces of music data, said associated pieces of first timing data and said pieces of second timing data from said first audio-visual station to said second visual station as a payload of packets.

4. The music performance system as set forth in claim 2, in which said another of said plural communication channels forms a part of a base-band transmission system.

5. The music performance system as set forth in claim 4, in which said base-band transmission system is a television conference system.

6. The music performance system as set forth in claim 4, in which said base-band transmission system is a streaming system.

7. The music performance system as set forth in claim 1, in which said pieces of music data are coded in formats defined in MIDI (Musical Instrument Digital Interface) protocols.

8. The music performance system as set forth in claim 1, in which said pieces of visual data are representative of a moving picture.

9. The music performance system as set forth in claim 8, in which said pieces of visual data are further representative of sound different from said music sound.

10. The music performance system as set forth in claim 9, in which said sound is monophonic sound to be transmitted through a television conference system together with said visual images.

11. The music performance system as set forth in claim 9, in which said sound and said visual images are transmitted through a streaming system.

12. An audio-visual station remote from a music sound generator and a visual image generator, comprising:

a music data source outputting pieces of music data representative of music sound together with associated pieces of first timing data representative of respective occurrences of said pieces of music data and pieces of second timing data representative of respective occurrences of pieces of periodical data to a communication channel;

a visual data source outputting pieces of visual data representative of at least an attribute of visual images and said pieces of periodical data to another communication channel independent of said communication channel; and a time keeper producing said pieces of periodical data at regular intervals, and determining a first time at which each of said pieces of music data occurs and a second time at which each of said pieces of periodical data occurs, thereby selectively supplying said pieces of first timing data, said pieces of second timing data and said pieces of periodical data to said music data source and said visual data source.

13. The audio-visual station as set forth in claim 12, in which said music data source includes a musical instrument on which a human player performs a piece of music.

14. The audio-visual station as set forth in claim 13, in which said musical instrument is a keyboard musical instrument.

15. The audio-visual station as set forth in claim 13, in which said music data source further includes a transmitter module connected to said communication channel so as to transmit said pieces of music data, said associated pieces of first timing data and said pieces of second timing data to another audio-visual station where said music sound generator and said visual image generator are installed.

16. The audio-visual station as set forth in claim 15, in which said transmitter module loads said pieces of music data, said associated pieces of first timing data and said pieces of second timing data in a data field of packets assigned to a payload, and transmits said packets through said communication channel to said another audio-visual station.

17. The audio-visual station as set forth in claim 12, in which said visual data source includes a camera through which said attribute of said visual images are converted to a part of said visual data.

18. The audio-visual station as set forth in claim 17, in which said visual data source further includes a microphone through which acoustic waves are converted to another part of said visual data.

19. The audio-visual station as set forth in claim 12, in which said time keeper includes an internal clock module for measuring said first time and said second time, a periodic data generator module outputting said pieces of periodic data to said visual data source and reading said second time from said internal clock module for producing said pieces of second timing data, and a time stamper module reading said first time from said internal clock for producing each of said pieces of first timing data when one of said pieces of music data codes occurs.

20. The audio-visual station as set forth in claim 19, in which said pieces of periodical data are transmitted to another audio-visual station where said music sound generator and said visual image generator are installed through a base-band transmission system, and said another communication channel forms a part of said base-band transmission system.

21. The audio-visual station as set forth in claim 19, in which each of said pieces of periodical data is represented by a predetermined pulse train.

22. An audio-visual station remote from a music data source and a visual data source and receiving pieces of music data representative of music sound, pieces of first timing data representative of respective occurrences of said pieces of music data, pieces of periodical data each representative of a sign of a time period, and pieces of second timing data representative of respective occurrences of said pieces of periodical data and pieces of visual data representative of an attribute of visual images for synchronously producing said music sound and said visual images, said audio-visual station comprising an internal clock module measuring a time, a clock setter module paring said pieces of second timing data with said pieces of periodical data to see whether or not a time difference between the arrivals thereat is ignoreable, and setting said internal clock right on the basis of said pieces of second timing data and said time difference if said time difference is not ignoreable, a visual image generator supplied with said pieces of visual data so as to produce said visual images, and a music sound generator comparing said time with another time expressed by said pieces of second timing data so as timely to produce said music sound synchronously with said visual images.

23. The audio-visual station as set forth in claim 22, further comprising a music data buffer for storing said pieces of music data and said associated pieces of first timing date, a time data buffer for storing said pieces of second timing data, and a receiver module receiving said pieces of music data, said pieces of first timing data and said pieces of second timing data and selectively transferring said pieces of music data, said pieces of first timing data and said pieces of second timing data to said music data buffer and said time data buffer so that said clock setter module reads out each piece of second timing data from said time data buffer when the associated piece of periodical data arrives thereat.

24. The audio-visual station as set forth in claim 22, in which said clock setter module measures a lapse of time from the arrival of each of said pieces of periodical data to see whether or not the associated piece of second timing data arrives thereat within a critical time, sets said internal clock to the sum of a time expressed by said associated piece of second timing data and said lapse of time when said lapse of time is equal to or shorter than said critical time, and cancels said each of said pieces of periodical data when said associated piece of second timing data does not arrive within said critical time.

25. The audio-visual station as set forth in claim 22, in which said clock setter module measures a lapse of time from the arrival of each of said pieces of second timing data to see whether or not the associated piece of periodical data arrives thereat within a critical time, sets said internal clock to a time expressed by said each of said pieces of second timing data when said lapse of time is equal to or shorter than said critical time, and cancels said each of said pieces of second timing data when said associated piece of periodical data does not arrive within said critical time.

* * * * *